US009010594B2

(12) United States Patent
Girault et al.

(10) Patent No.: US 9,010,594 B2
(45) Date of Patent: Apr. 21, 2015

(54) ADJUSTMENT DEVICE FOR A PORTABLE ELEMENT

(71) Applicant: Zedel, Crolles (FR)

(72) Inventors: Eric Girault, Annecy (FR); Grégory Martin, Les Adrets (FR)

(73) Assignee: Zedel, Crolles (FR)

( * ) Notice: Subject to any disclaimer, the term of this patent is extended or adjusted under 35 U.S.C. 154(b) by 0 days.

(21) Appl. No.: 14/176,772

(22) Filed: Feb. 10, 2014

(65) Prior Publication Data

US 2014/0201950 A1 Jul. 24, 2014

(30) Foreign Application Priority Data

Jan. 21, 2013 (FR) ..... 13 00127

(51) Int. Cl.

| | |
|---|---|
| ***A44B 11/02*** | (2006.01) |
| ***F21V 21/084*** | (2006.01) |
| *H04R 1/02* | (2006.01) |
| *A45F 5/00* | (2006.01) |
| *A42B 1/24* | (2006.01) |

(52) U.S. Cl.

CPC ..... *A44B 11/02* (2013.01); *Y10T 24/21* (2015.01); *Y10T 24/1397* (2015.01); *H04R 1/02* (2013.01); *A45F 5/00* (2013.01); *A42B 1/24* (2013.01); *F21V 21/084* (2013.01); *Y10S 224/908* (2013.01)

(58) Field of Classification Search

USPC ..... 224/181, 908, 648, 637, 631

See application file for complete search history.

(56) References Cited

U.S. PATENT DOCUMENTS

| | | | | | |
|---|---|---|---|---|---|
| 4,168,022 | A * | 9/1979 | Brewer | 224/257 |
| 4,461,411 | A * | 7/1984 | Harrow | 224/617 |
| 4,764,962 | A * | 8/1988 | Ekman et al. | 381/301 |
| 5,016,797 | A * | 5/1991 | Rowledge | 224/257 |
| D342,348 | S * | 12/1993 | Panarelli | D29/101.1 |
| 5,289,960 | A * | 3/1994 | Kelly et al. | 224/664 |
| 5,291,816 | A * | 3/1994 | Adams | 84/327 |
| 5,307,967 | A * | 5/1994 | Seals | 224/257 |
| 5,323,942 | A * | 6/1994 | Dahan | 224/639 |
| 5,333,768 | A * | 8/1994 | Krentz | 224/623 |
| D364,270 | S * | 11/1995 | Kellerman | D3/218 |
| 6,152,342 | A * | 11/2000 | Suk | 224/645 |
| D435,168 | S * | 12/2000 | Momburg | D3/215 |
| 6,179,175 | B1 * | 1/2001 | Painter | 224/153 |
| 6,311,884 | B1 * | 11/2001 | Johnson | 224/627 |
| D509,627 | S * | 9/2005 | Willows et al. | D29/101.2 |
| 7,210,605 | B2 * | 5/2007 | Willows et al. | 224/637 |
| 7,857,181 | B2 * | 12/2010 | Sacks | 224/579 |
| 2004/0128745 | A1 | 7/2004 | Cleary et al. | |
| 2011/0261556 | A1 | 10/2011 | Gibson et al. | |
| 2012/0008309 | A1 | 1/2012 | Hale | |
| 2014/0201953 | A1 * | 7/2014 | Girault et al. | 24/131 R |

FOREIGN PATENT DOCUMENTS

WO WO 2009/092043 A1 7/2009

* cited by examiner

*Primary Examiner* — Brian D Nash

(74) *Attorney, Agent, or Firm* — Oliff PLC

(57) ABSTRACT

The adjustment device for a portable element comprises two elementary strands and two adjustment units each comprising a slide path for one of the elementary strands and a fixing system for one of the ends of the other of the elementary strands, the slide path of one of the elementary strands being laterally offset with respect to the fixing system of the other of the elementary strands.

16 Claims, 3 Drawing Sheets

ADJUSTMENT DEVICE FOR A PORTABLE ELEMENT

BACKGROUND OF THE INVENTION

The present invention relates to an adjustment device for a portable element, and more particularly to an improved adjustment device for a portable element enabling simple, fast and efficient adjustment.

STATE OF THE ART

Adjustment devices for portable elements are very widely used in particular in the sporting field. This is the case in particular of devices for ensuring correct positioning of headlamps, snow goggles or a diving mask, swimming goggles, etc.

Adjustment devices available at present on the market, in particular those for snow goggles, are in the form of a single unit enabling adjustment of the length of a strap passing around the user's head and performing securing of the portable element. The adjustment unit comprises a slide path enabling the strap to be diverted and a fixing area of said strap. Associated with the adjustment unit, a ring enables the strap, passing through the ring, to make a loop between said ring and the adjustment unit. The separating distance between the ring and the adjustment unit enables the length of the strap to be adjusted. This type of device presents the drawback of not being very practical when the user wishes to modify the adjustment without removing the portable element while continuing his or her activity. Indeed, to adjust this type of device, the user has to hold the sliding strand in the single adjustment unit and make the adjustment unit slide on the latter. The user therefore first has to determine which of the two elements present on the strap is the adjustment unit and then which of the strands is sliding on the adjustment unit. He or she then has to perform sliding of the adjustment unit along said sliding strand. Such an adjustment is therefore relatively long and laborious when the user is performing his or her activity, all the more so as the adjustment unit and the ring are generally positioned at the back of the head.

Adjustment devices for portable elements of swimming or diving goggle type, also exist in the form of two adjustment units arranged specifically on each side of the portable element, on the support of said element itself. These types of device are sometimes provided with a particular headstrap, generally silicone-based, comprising a splitting zone fixed at the level of the occipital part of the head. Such a strap achieves good securing of the portable element, but adjustment of the strap length of such a device remains difficult to perform. In particular, the user tends to exert a stronger pull on the adjustment strap on one side than on the other, which results in non-symmetric adjustment of the splitting zone with respect to the sagittal plane. The splitting zone, which is incorrectly positioned, then loses its efficiency in terms of securing of the portable element.

OBJECT OF THE INVENTION

The present invention tends to resolve the shortcomings of traditional adjustment devices by proposing an improvement for adjustment devices for portable elements.

According to the invention, this object is achieved by means of an adjustment device for a portable element comprising two elementary strands and two adjustment units each comprising a slide path for one of the elementary strands and a fixing system for one of the ends of the other of the elementary strands, the slide path of one of the elementary strands being laterally offset with respect to the fixing system of the other of the elementary strands.

Preferably, the adjustment units of the adjustment device comprise a slide path of one of the elementary strands laterally offset in a direction perpendicular to the longitudinal axis of the elementary strands with respect to the fixing system of the other of the elementary strands, and a fixing system of an elementary strand on the adjustment unit configured so that the elementary strand is oriented in a different direction from the other elementary strand in the slide path.

According to a preferred embodiment, the two elementary strands form part of one and the same strand. In this embodiment, the portable element can be fitted sliding along the strand.

According to another embodiment, the first and second strands are of the same length.

According to a preferred embodiment, the single strand or a support area enables fixing of a portable element. This portable element is in particular a headlamp.

BRIEF DESCRIPTION OF THE DRAWINGS

Other advantages and features will become more clearly apparent from the following description of particular embodiments of the invention given for non-restrictive example purposes only and represented in the appended drawings, in which.

DESCRIPTION OF PARTICULAR EMBODIMENTS

Figure 1:
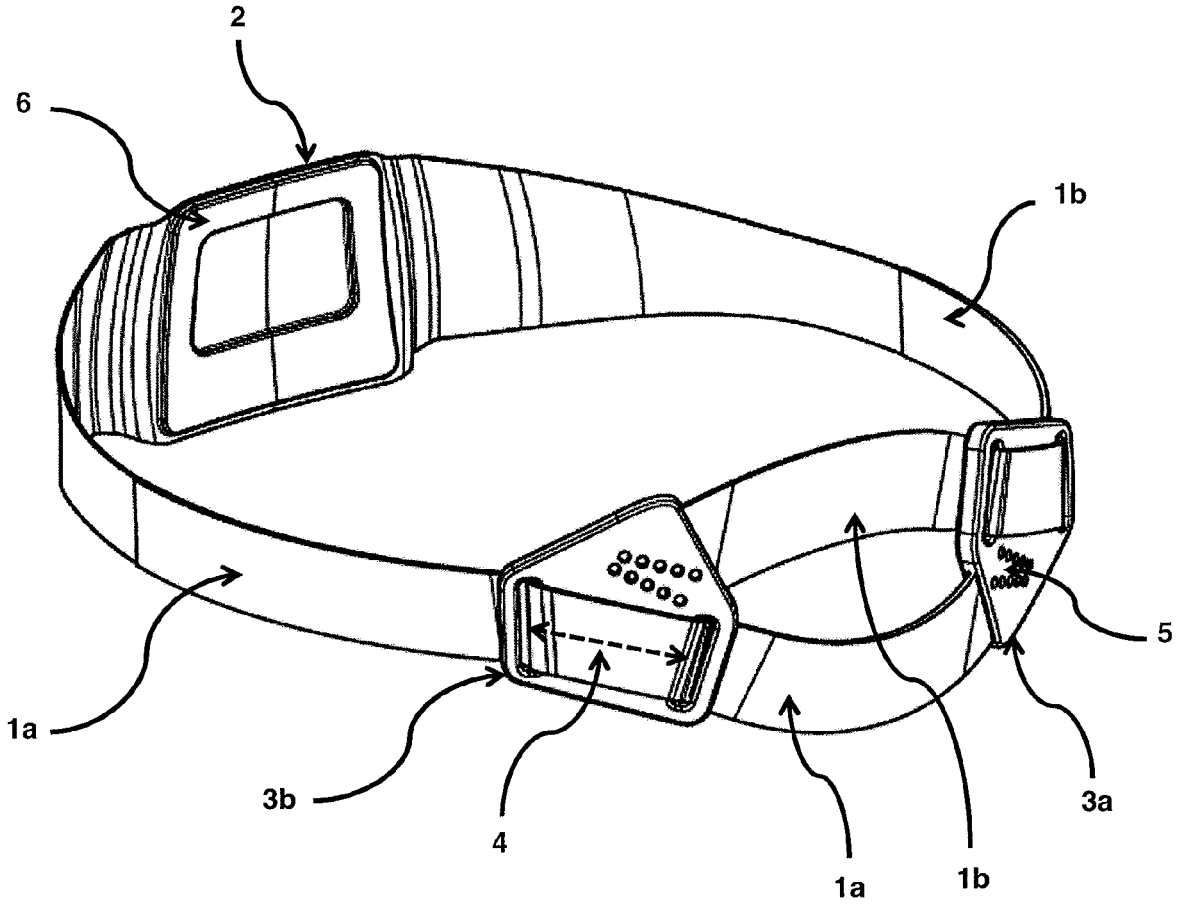
FIGS. 1 and 2 schematically illustrate a perspective view of an embodiment of an adjustment device for a portable element.
Figure 2:
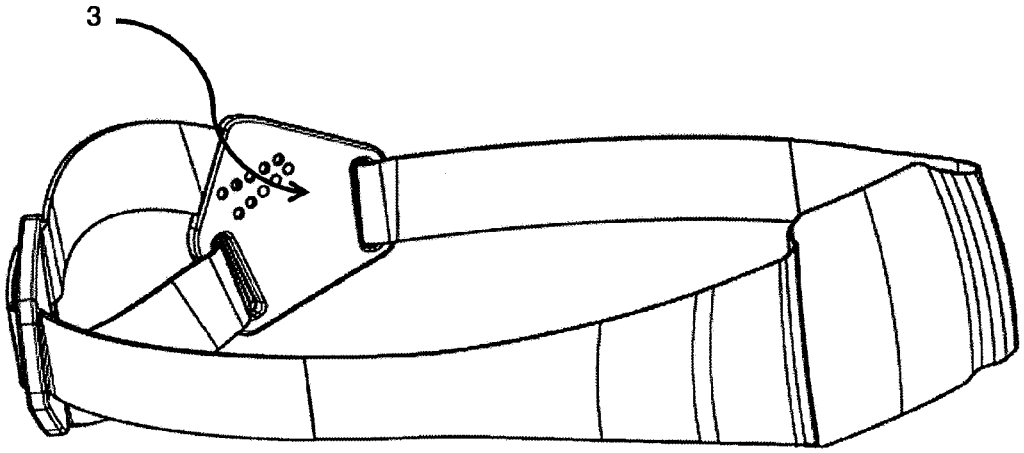

The adjustment device for a portable element comprises two elementary strands 1 and two adjustment units 3 each comprising a slide path 4 for one of the elementary strands and a fixing system 5 for one of the ends of the other of the elementary strands. For a given adjustment unit 3, slide path 4 of one of the elementary strands is laterally offset with respect to the fixing system of the other of the elementary strands.

According to a first embodiment of the invention, the two elementary strands 1 form part of one and the same strand. In such an embodiment, each elementary strand then has one end defined by the connection to the portable element and the other end defined by the fixing to one of adjustment units 3. The single strand therefore has both its ends fixed to one of adjustment units 3. The portable element is assembled to the single strand by any means known to the person skilled in the art, in fixed or sliding manner on said strand. According to an advantageous embodiment, the portable element is fitted sliding along the strand.

FIG. 1 presents a schematic perspective view of an adjustment device according to a particular embodiment. Said device comprises two elementary strands 1*a* and 1*b* having a part connected to a support area 2 of the portable element fixed to the adjustment device by means of said elementary strands and two adjustment units 3 (3*a* and 3*b*) each comprising a slide path 4 for one of the elementary strands and a fixing system 5 for the other elementary strand. The device more particularly comprises a first adjustment unit 3*a* comprising a slide path 4 of second elementary strand 1*b* and a fixing system 5 of first elementary strand 1*a*. It also comprises a second adjustment unit 3*b* comprising a slide path 4 of first elementary strand 1*a* and a fixing system 5 of second elementary strand 1*b*. Each elementary strand is thus fixed on one side to support area 2 and on the other side to its adjustment unit 3. The other elementary strand passes through each adjustment unit 3 via slide path 4.

Such a device enables quick adjustment that is able to be performed even when the user is equipped with the portable element and is for example performing a physical activity. The user simply has to move the adjustment units towards one another or on the contrary move them away from one another to obtain an optimum adjustment of the length of the device.

Slide paths 4 can comprise two pass-through holes 7 whereby an elementary strand can be made to pass from a first main side to the opposite main side and said elementary strand can then be brought back onto the first main side (FIGS. 1-3 and 5). Slide paths 4 thereby enable the elementary strands to be deviated, said deviation being a means for preventing non-controlled sliding of adjustment unit 3 along the strand when the strand is stretched on each side of adjustment unit 3. Thus, when a tension is applied on the elementary strand on one side of adjustment unit 3 only, the strand slides in slide path 4. When the same tension is applied on the elementary strand on both sides of adjustment unit 3, the elementary strand remains fixed and no longer slides along slide path 4.

According to one embodiment, in particular when the strand is a strap or a strip, one of the main sides of the adjustment unit corresponds to the side in contact with the head or a helmet (FIG. 1-5).

Figure 3:
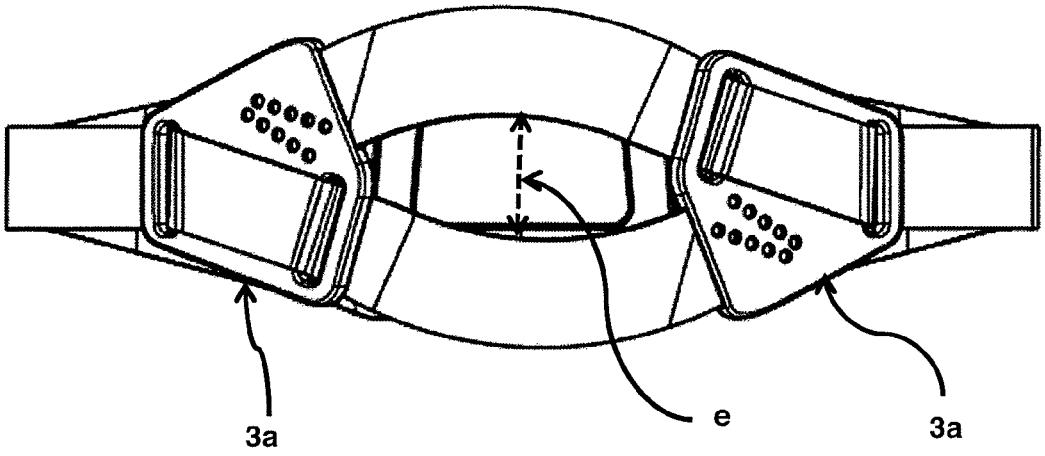
FIG. 3 schematically illustrates a rear view of an embodiment of an adjustment device for a portable element.
Figure 4:
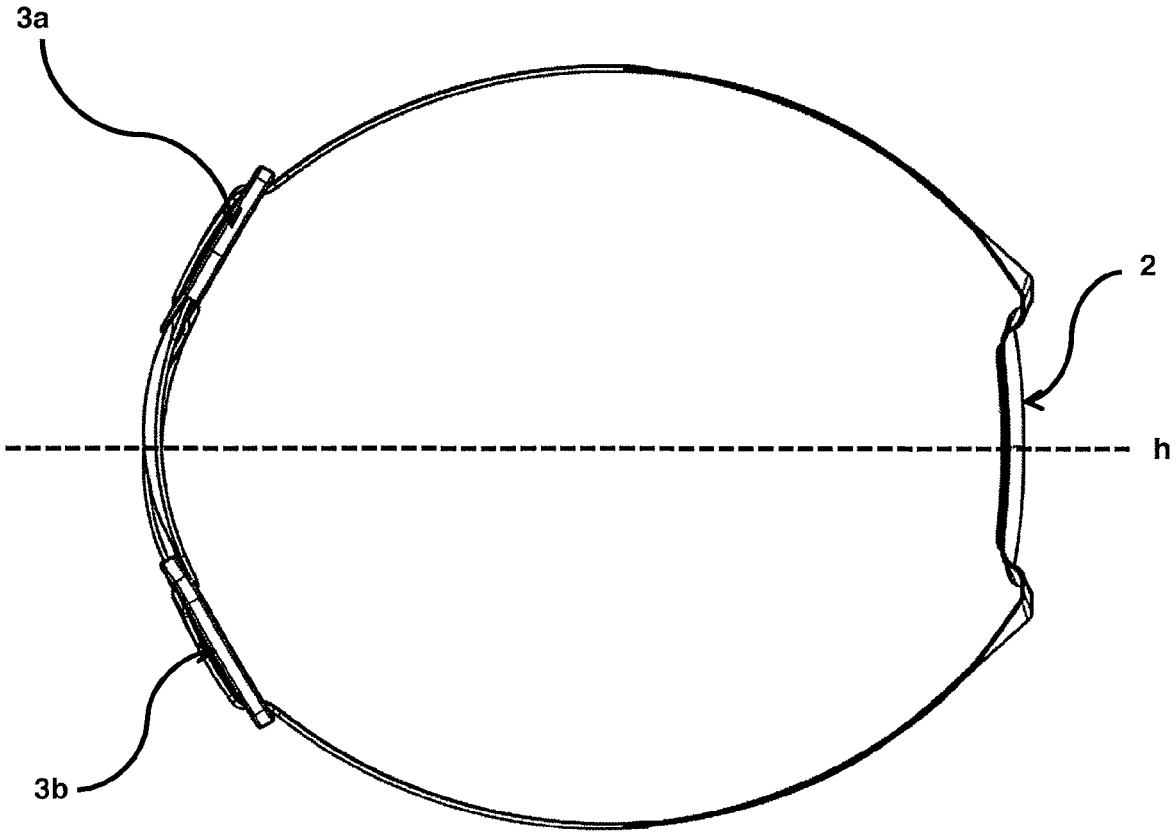
FIG. 4 schematically illustrates a top view of an embodiment of an adjustment device.

Slide path 4 of each elementary strand is laterally offset with respect to fixing system 5 of the other elementary strand. The lateral offset is an offset of the two elementary strands 1*a* and 1*b* in a direction perpendicular to the longitudinal axis (the largest dimension) of the elementary strands. The two elementary strands are substantially in the same plane, even when the strands are straps. Such an offset enables a separating distance e of the elementary strands between adjustment units 3 (FIGS. 3 and 6). Such a separating distance e thus ensures excellent securing of the portable element in particular due to double pressing of the fixing device. When the portable element is positioned on the forehead, said double pressing is preferably positioned at the rear of the head, each of the strands being positioned symmetrically on each side of the plane passing via the portable element, said plane being perpendicular to the sagittal plane.

Figure 5:
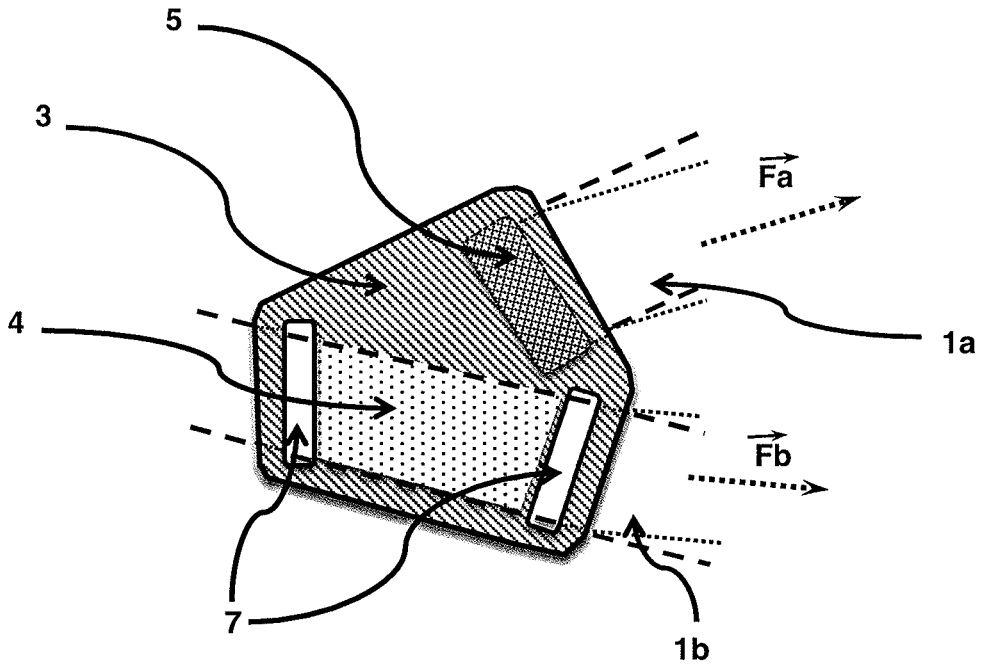
FIG. 5 schematically illustrates a view of one of the main sides of an embodiment of the adjustment unit.

Fixing system 5 of an elementary strand on adjustment unit 3 is configured in such a way that the elementary strand is oriented in a different direction from the other elementary strand in a slide path 4 (FIGS. 3 and 5). When a tension is applied on the elementary strands, at least two different forces (F, FIG. 5) are applied on adjustment unit. A first force Fa is applied by first strand 1*a* and tends to orient the adjustment unit in a first direction. A second force Fb is applied by second strand 1*b* and tends to orient the adjustment unit in a second direction different from the first direction. The adjustment unit is consequently oriented between these two directions and creates a friction force which opposes movement of strand 1*b* inside the slide path.

Fixing of the elementary strand or strands on adjustment units 3 at the level of fixing systems 5, and possibly on support area 2, can be achieved by any means known to the person skilled in the art, for example by means of sewing, soldering or sticking techniques.

Elementary strand 1 can be of any type and of any suitable shape. What is meant by strand is in particular any type of longitudinal flexible element designed to perform fixing, adjustment or securing. This can therefore involve a flat strap of any width or an element of cord type of any diameter. The basis of the elementary strands is preferably formed by an extensible material. In all cases, it is a longitudinal element, having a length that is much larger than its diameter and/or its width.

In one embodiment, support area 2 is designed to receive the portable element. In particular, it can for example be formed by a rigid plate when the portable element is a headlamp. Inner side 6 (FIG. 1) of support area 2 can if required be covered by an elastically deformable material to enhance user comfort.

Adjustment units 3 can be of any type and of any suitable shape. They can in particular be made from plastic or from metal.

What is meant by strand length in the following is the length of strand that separates the portable element or support area 2 from adjustment unit 3. According to a preferred embodiment, the adjustment device comprises two elementary strands 1*a* and 1*b* of the same length. Such a device thus enables symmetric adjustment with respect to the portable element. The tension exerted by the two elementary strands on each side of support area 2 is then always of the same intensity, guaranteeing optimum comfort for the user. Symmetrical positioning of the adjustment units with respect to the axis h (FIG. 4), perpendicular to support area 2, also enables the portable element to be kept in place even if the user is adjusting the length of the device. Indeed, when the movement necessary for adjustment is a tension on only one of the fixing areas of the support area (case of non-symmetric adjustments), this tension creates a risk of the support area losing its adhesion with respect to the element on which it is positioned. In such a case, the support area, which can for example purposes be the rubber support frame of a diving mask, then no longer performs its sealing function. On the contrary in the present device, the two strands are connected to the two adjustment units 3 and movement of an adjustment unit on an elementary strand thus results in movement of the other adjustment unit on the other elementary strand. The support area remains perfectly well positioned on the element on which it is placed, even when adjustment of the length of the elementary strands is performed.

The same is the case when the strand is a single strand and the portable element is placed in the middle of the strand.

The adjustment device is more particularly suitable for fixing a headlamp.

In advantageous manner, when the strand is a strap, the inlet and outlet slots of the pass-through hole are not parallel in order to increase the friction forces.

The portable element can be configured to be placed on the head, a helmet, an arm or another element. Preferably, the adjustment device associated with the portable element is configured to be placed on the user's head or on a helmet.

The invention claimed is:

1. An adjustment device comprising:

two elementary strands; and two adjustment units, which are separate and distinct from each other, one of the adjustment units comprising:

a slide path that receives one of the elementary strands, so that the elementary strand slides with respect to the adjustment unit; and a fixing system that fixes an end of the other of the elementary strands to the adjustment unit, wherein:

the slide path of said one of the elementary strands is laterally offset in a direction perpendicular to the longitudinal axis of the elementary strands with respect to the fixing system of the other of the elementary strands, and the fixing system of one of the elementary strands on the adjustment unit is configured so that the elementary strand is oriented in a different direction from the other elementary strand in the slide path.

2. The adjustment device according to claim 1, wherein the two elementary strands form part of one and the same strand.

3. A portable element comprising:

the adjustment device according to claim 2, wherein the portable element is configured to slide along the strand.

4. The adjustment device according to claim 1, wherein the first and second elementary strands are of the same length.

5. A device comprising:

a headlamp, and the adjustment device according to claim 1.

6. The adjustment device according to claim 1, wherein each of the two elementary strands comprise a strap.

7. The adjustment device according to claim 1, wherein the sliding path is defined by two opposite slits defined in a surface of the adjustment unit.

8. The adjustment device according to claim 7, wherein the two opposite slits are not parallel.

9. The adjustment device according to claim 1, further comprising a support area, the support area comprising an internal face covered by an elastically deformable material.

10. The adjustment device according to claim 1, wherein the two elementary strands comprise an extensible material.

11. The adjustment device according to claim 1, wherein the fixing system comprises a portion in which the end of the other of the elementary strands is fixed to the adjustment unit by sewing, soldering, or sticking techniques.

12. An adjustment device comprising:

a plurality of elementary strands, the plurality of elementary strands comprising a first elementary strand and a second elementary strand; and a plurality of adjustment units, the plurality of adjustment units comprising:

(i) a first adjustment unit, the first adjustment unit comprising:

a first slide portion, the first slide portion receiving the first elementary strand such that the first elementary strand slides within the first adjustment unit along a longitudinal direction of the first elementary strand; and a first fixing portion that fixes an end portion of the second elementary strand to the first adjustment unit such that the second elementary strand is not able to slide inside the adjustment unit along a longitudinal direction of the second elementary strand; and (ii) a second adjustment unit, the second adjustment unit comprising:

a second slide portion, the second slide portion receiving the second elementary strand such that the second elementary strand slides within the second adjustment unit along the longitudinal direction of the second elementary strand; and a second fixing portion that fixes an end portion of the first elementary strand to the second adjustment unit such that the first elementary strand is not able to slide inside the second adjustment unit along the longitudinal direction of the first elementary strand, wherein the first fixing portion fixes the end portion of the second elementary strand to the first adjustment unit such that the longitudinal axis of the end portion of the second elementary strand is oriented in a different direction from the longitudinal axis of a portion of the first elementary strand within the first slide portion, and wherein the second fixing portion fixes the end portion of the first elementary strand to the second adjustment unit such that the longitudinal axis of the end portion of the first elementary strand is oriented in a different direction from the longitudinal axis of a portion of the second elementary strand within the second slide portion.

13. The adjustment device according to claim 12, wherein the first and second elementary strands form part of one and the same strand.

14. A portable element comprising:

the adjustment device according to claim 13, wherein the portable element is configured to slide along the strand.

15. The adjustment device according to claim 13, wherein the first and second elementary strands are of the same length.

16. A device comprising:

a headlamp; and the adjustment device according to claim 12.

* * * * *